US006641279B1

(12) United States Patent
Williams

(10) Patent No.: US 6,641,279 B1
(45) Date of Patent: Nov. 4, 2003

(54) DUAL-BEAM LIGHT ASSEMBLY WITH ADJUSTABLE POSTERIOR HEAD

(76) Inventor: Wilson Williams, 594 Hegeman Ave., Apt. 2R, Brooklyn, NY (US) 11027

( * ) Notice: Subject to any disclaimer, the term of this patent is extended or adjusted under 35 U.S.C. 154(b) by 57 days.

(21) Appl. No.: 09/998,980

(22) Filed: Nov. 1, 2001

(51) Int. Cl.[7] ..... F21L 4/00; F21L 4/04

(52) U.S. Cl. ..... 362/184; 362/197; 362/198; 362/199

(58) Field of Search ..... 362/184, 197, 362/198, 199, 202, 205

(56) References Cited

U.S. PATENT DOCUMENTS

| | | | | | |
|---|---|---|---|---|---|
| 3,030,497 | A | | 4/1962 | Cheng | 362/184 |
| 4,467,403 | A | | 8/1984 | May | 362/250 |
| D349,776 | S | | 8/1994 | Yuen | D26/37 |
| D363,564 | S | | 10/1995 | Kish et al. | D26/49 |
| D370,989 | S | | 6/1996 | Garrity | D26/49 |
| D371,855 | S | | 7/1996 | Heun | D26/43 |
| 5,541,822 | A | * | 7/1996 | Bamber | 362/190 |
| 5,558,430 | A | * | 9/1996 | Booty, Jr. | 362/184 |
| D407,515 | S | | 3/1999 | Yang et al. | D26/49 |
| 5,971,562 | A | | 10/1999 | Yang | 362/184 |
| 5,988,828 | A | * | 11/1999 | Prince et al. | 362/199 |

* cited by examiner

*Primary Examiner*—Sandra O'Shea
*Assistant Examiner*—Bao Truong
(74) *Attorney, Agent, or Firm*—John D. Gugliotta

(57) ABSTRACT

A dual-beam light assembly with adjustable posterior head provides a single lighting device for providing ample light for at least two persons walking in single file in an environment devoid of light. The dual-beam light assembly with adjustable posterior head has a pair of opposed, axially oriented, light emitting heads separated by a circular, hollow barrel which houses internal components. Flashlight bulbs are wired in a parallel circuit arrangement with the only common circuit elements being the power source. Two independent switches are provided to allow the flashlight bulbs to operate independently of one another. The barrel is made of high-impact plastic. A posterior end of the barrel includes a pivot assembly allowing for selective pivotal adjustment of the second light-emitting head to a plurality of specific angular settings.

18 Claims, 4 Drawing Sheets

DUAL-BEAM LIGHT ASSEMBLY WITH ADJUSTABLE POSTERIOR HEAD

RELATED APPLICATIONS

The present invention was first described in Disclosure Document No. 493,312 filed on May 10, 2001. There are no previously filed, nor currently any co-pending applications, anywhere in the world.

BACKGROUND OF THE INVENTION

1. Field of the Invention

The present invention relates generally to dual beam flashlights and, more particularly, to a dual-beam light assembly with adjustable posterior head.

2. Description of the Related Art

The standard flashlight has found a well-deserved place in toolboxes everywhere. It is the perfect tool for providing light almost anywhere. It can be used to provide supplemental light in dimly lit locations, and provide the sole source of light in locations without any light or during a power failure. One common use for a flashlight is to light a path while walking in-line with someone else such as in a tunnel or down a path. During such use, the lead person swings the beam side-to-side to light the way. Unfortunately, if those following do not have their own flashlight, they may stumble in the dark. Additionally, if the lead person gets too far ahead, those following may have difficulty in locating them, since the light beam is aimed in the other direction.

Accordingly, there is a need for a means by which the sue of a single flashlight can be beneficial for those walking in-line or down a narrow path in dimly lit areas. The development of the dual-beam light assembly with adjustable posterior head fulfills this need.

A search of the prior art did not disclose any patents that read directly on the claims of the instant invention; however, the following references were considered related. The following patents disclose the design and function for a twin-headed flashlight: U.S. Pat. No. 5,971,562 issued in the name of Yang; and U.S. Pat. No. D 407,515 issued in the name of Yang et al.

The following patents describe a twin-beam portable light assembly:

U.S. Pat. No. 5,558,430 issued in the name of May; and U.S. Pat. No. 4,467,403 issued in the name of Booty, Jr.

The following patents disclose the ornamental design for a flashlight:

U.S. Pat. No. D 370,989 issued in the name of Garrity; and U.S. Pat. No. D 363,564 issued in the name of Kish et al.

U.S. Pat. No. 3,030,497 issued in the name of Cheng describes an electric lantern with a plurality of holders and lamps.

U.S. Pat. No. D 371,855 issued in the name of Huen describes the ornamental design for a flexible flashlight.

U.S. Pat. No. D 349,776 issued in the name of Yuen discloses the ornamental design for a combined fluorescent lamp and flashlight.

Consequently, a need has been felt for a dual headed flashlight which allows for the temporary lighting of two separate areas in a manner which is especially beneficial for multiple people walking in a line or down a path.

SUMMARY OF THE INVENTION

Therefore, it is an object of the present invention to provide a flashlight with two lens assemblies which functions like a conventional flashlight, but with two reflector assemblies.

It is another object of the present invention to provide a flashlight with two lens assemblies used while walking in-line with another person or down a path.

It is still another object of the present invention to provide a flashlight with two lens assemblies which allows lead person to see where they are going, while guiding those behind.

It is still another object of the present invention to provide a device with dual light assemblies which projects light beams approximately 180° apart.

It is another object of the present invention to provide a device with dual light assemblies with lamps wired in series with separate switches.

It is another object of the present invention to provide a device with dual light assemblies which allows independent lamp operation.

It is another object of the present invention to provide a device with dual light assemblies for providing redundant operation in the event of lamp failure in one light.

It is another object of the present invention to provide a battery-operated device having a set of replaceable batteries for powering both lights and which allows operation anywhere.

Briefly described according to one embodiment of the present invention, a dual-beam light assembly with adjustable posterior head is disclosed comprising a pair of opposed, axially oriented, light emitting heads. The present invention closely resembles a common two-cell flashlight, with the exception of an additional light and reflector assembly in lieu of a closing cap. The lights are wired in a parallel circuit arrangement with the only common circuit elements being the power source, or replaceable batteries. Two independent switches are provided to allow the lamps to operate independently of one another, that is, one lamp can operate, the other lamp can operate, or they both can operate simultaneously. The barrel or enclosure is made of high-impact plastic, or alternatively, of aluminum. A posterior end of the barrel includes a pivot assembly allowing for selective pivotal adjustment of the second head to a plurality of specific angular settings.

The use of the present invention allows for the temporary lighting of two separate areas in a manner which is especially beneficial for multiple people walking in a line or down a path.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
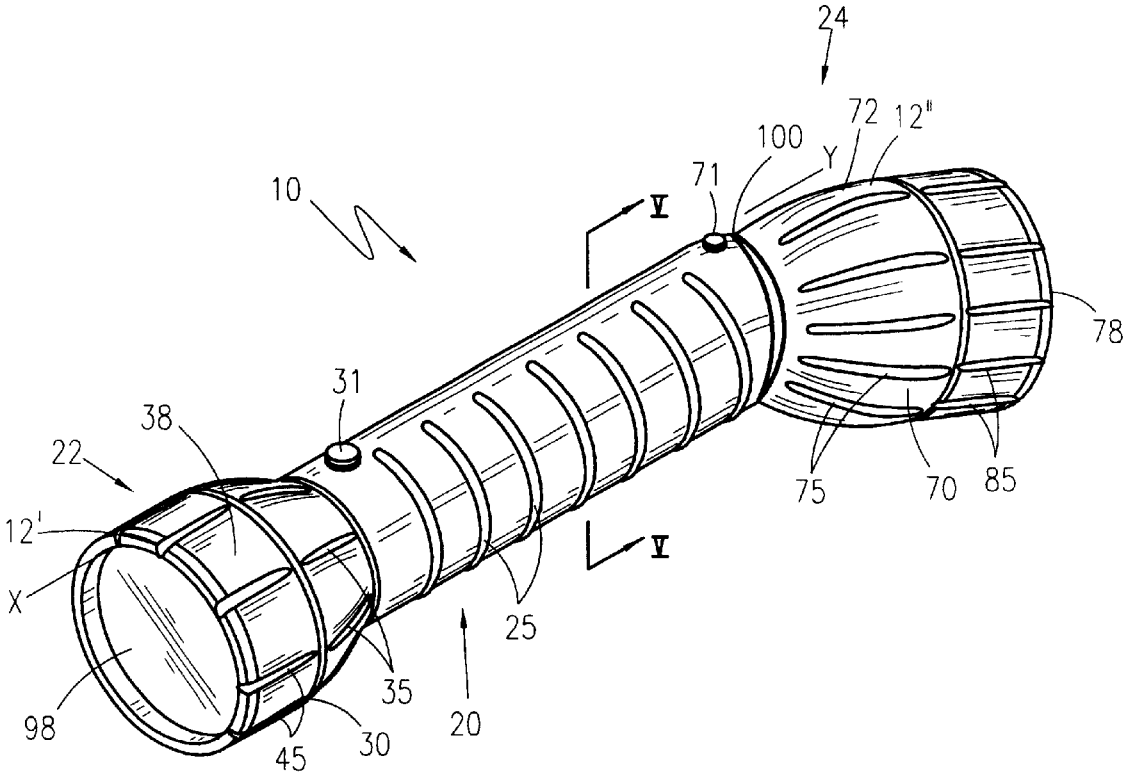
FIG. 1 is a perspective view of a dual-beam light assembly with adjustable posterior head according to the preferred embodiment of the present invention.
Figure 2:
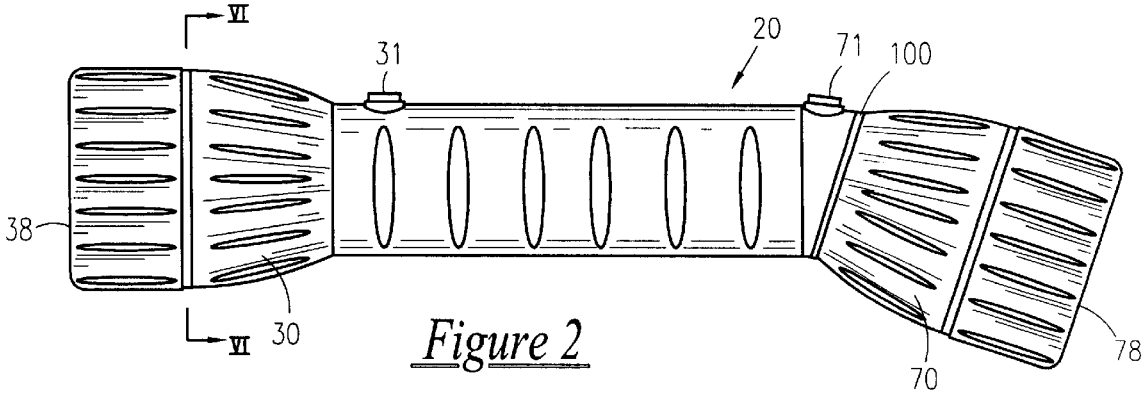
FIG. 2 is a side elevational view of the dual-beam light assembly with adjustable posterior head according to the preferred embodiment of the present invention.
Figure 3A:
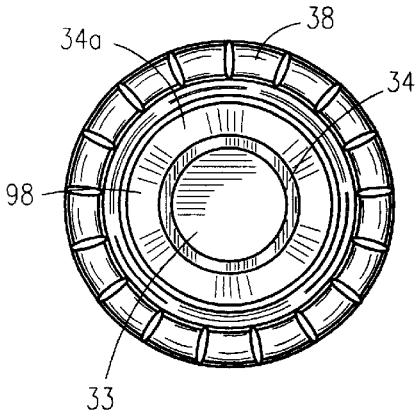
FIG. 3*a* is a front end view of the end cap located at the anterior end of the dual-beam light assembly with adjustable posterior head according to the preferred embodiment of the present invention.
Figure 3B:
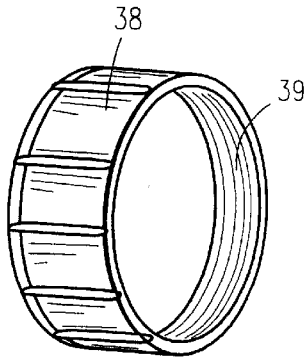
FIG. 3*b* is a side elevational view of the end cap located at the anterior end of the dual-beam light assembly with adjustable posterior head according to the preferred embodiment of the present invention.
Figure 4A:
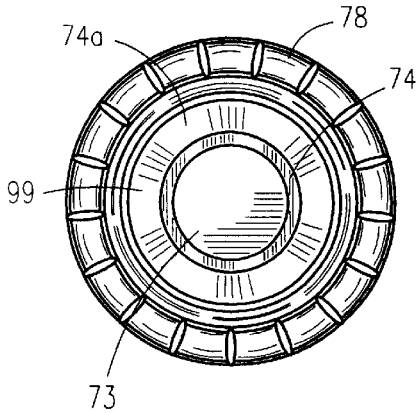
FIG. 4*a* is a front end view of the end cap located at the posterior end of the dual-beam light assembly with adjustable posterior head according to the preferred embodiment of the present invention.
Figure 4B:
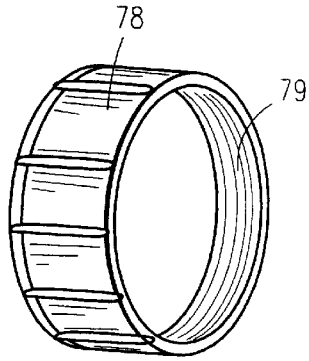
FIG. 4*b* is a side elevational view of the end cap located at the posterior end of the dual-beam light assembly with adjustable posterior head according to the preferred embodiment of the present invention.

Referring now to FIGS. 1–4*b*, a dual-beam light assembly with adjustable posterior head 10 is shown, according to the present invention, comprised of a linearly elongated, circular, hollow barrel 20 having an anterior end 22 opposite a posterior end 24. In order to enhance a user's grip of the barrel 20, a series of structurally integral, elongated ridge members 25 are circumferentially aligned therearound in a spaced-apart parallel manner, being perpendicular with respect a horizontal plane represented by xy.

The anterior end 22 includes a first head 30 defined as having a generally conical-shaped neck 32 with end cap receiving threads 37 formed circumferentially around a mouth portion 36 thereof for allowing an end cap 38 to be removably coupled thereto. A series of structurally integral, linearly elongated ridge members 35 are circumferentially aligned in a closely-spaced parallel manner around an external circumferential surface of the neck 32. The ridge members 35 are perpendicularly aligned with respect to the mouth portion 36 of the neck 32 and are provided not only for aesthetic purposes, but also to facilitate enhanced grip of the dual-beam light assembly with adjustable posterior head 10 during use.

The end cap 38 is of a circular, hollow configuration with complementary threads 39 formed therein for allowing the end cap 38 to be removably coupled to the mouth portion 36 of the neck 32. Removal of the end cap 38 provides access to an interior of the neck 32, within which resides a flashlight bulb 33, and further provides access to an internal cavity 40 of the barrel 20, within which a power source 44 and internal electrical circuitry 50 (to be described in greater detail below) are housed. The end cap 38 includes a series of structurally integral, linearly elongated ridge members 45 circumferentially aligned in a parallel manner around an external circumferential surface thereof. The ridge members 45 extend in a longitudinal direction with respect to ridge members 35 of the neck 32, and are spaced apart at a distance greater than the ridge members 35 thereof. The ridge members 45 serve to enhance a user's grip for facilitating easy removal and replacement of the end cap 38, a need which typically arises when battery removal and replacement is required. The ridge members 45 further add to the decorative features of the present invention. The end cap 38 further includes an oval lens 98 suitably disposed along an inner periphery thereof.

The posterior end 24 of the barrel 20 includes a pivot assembly 60 (to be described in greater detail below) for allowing selective adjustment of a second head 70.

The second head 70 is defined as having a generally conical-shaped neck 72 with end cap receiving threads 77 formed circumferentially around a mouth portion 76 thereof for allowing an end cap 78 to be removably coupled thereto. A series of structurally integral, linearly elongated ridge members 75 are circumferentially aligned in a closely-spaced parallel manner around an external circumferential surface of the neck 72. The ridge members 75 are perpendicularly aligned with respect to the mouth portion 76 of the neck 72 and are provided not only for aesthetic purposes, but also to facilitate enhanced grip of the dual-beam light assembly with adjustable posterior head 10 during use.

The end cap 78 is of a circular, hollow configuration with complementary threads 79 formed therein for allowing the end cap 78 to be removably coupled to the mouth portion 76 of the neck 72. Removal of the end cap 78 provides access to an interior of the neck 72, within which resides a flashlight bulb 73. The end cap 78 includes a series of structurally integral, linearly elongated ridge members 85 circumferentially aligned in a parallel manner around an external circumferential surface thereof. The ridge members 85 extend in a longitudinal direction with respect to ridge members 75 of the neck 72, and are spaced apart at a distance greater than the ridge members 75 thereof. The ridge members 85 serve to enhance a user's grip for facilitating easy removal and replacement of the end cap 78, a need typically arising in the event the flashlight bulb 73 requires replacement. The ridge members 85 further add to the decorative features of the present invention. The end cap 78 further includes an oval lens 99 suitably disposed along an inner periphery thereof.

Figure 5:
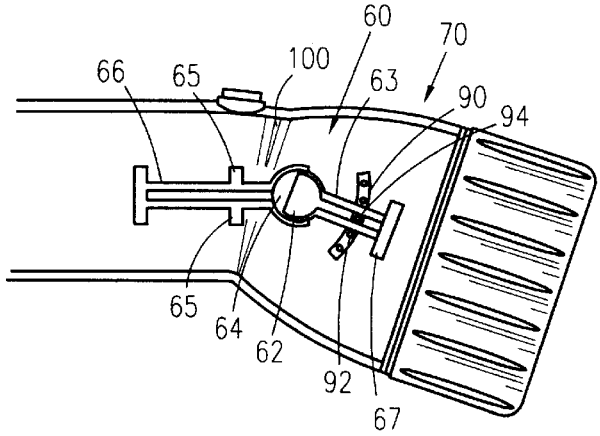
FIG. 5 is a cross-sectional view of the pivot assembly taken along lines V—V of FIG. 1, according to the preferred embodiment of the present invention.

Referring now to FIG. 5, the pivot assembly 60 is comprised of a ball joint 62 rotatably joined to a socket member 64. The socket member 64 includes a T-shaped anchoring arm 66 formed integral at an end thereof which is mounted to an internal circumferential sidewall of the barrel 20. The socket member 64 is further defined as having a pair of anchoring shoulders 65 integrally formed along opposite outer sidewalls, along a linearly elongated centerline thereof, which are mounted to an internal circumferential sidewall of the posterior end 24 of the barrel 20. The anchoring shoulders 65 function to provide added structural rigidity and ensured anchoring to the socket member 64.

The ball joint 62 includes an elongated pivoting arm 63 having a T-shaped end 67 mounted to an internal circumferential sidewall of the neck 72.

In order to allow for selective pivotal adjustment of the second head 70 to a plurality of specific angular settings, a pivotal adjustment arm 90 is provided. The pivotal adjustment arm 90 is defined as having an arcuate shape and includes a plurality of pin receiving apertures 92 spaced equidistant thereabout. The pivotal adjustment arm 90 is suitably mounted to an internal circumferential sidewall of the neck 72 in a location being opposite of a mounting location of the pivoting arm 63 of the ball joint 62.

A spring-loaded pin 94, located along a linearly elongated centerline of the pivoting arm 63, is designed so as to cooperate with the plurality of pin receiving apertures 92 of the pivotal adjustment arm 90.

Longitudinal force applied to the second head 70 serves to bias the spring-loaded pin 94 in a lateral direction so as to be effectively removed from a selected pin receiving aperture, until cooperating with an adjacent pin receiving aperture, whereby the second head 70 is there held in position. The plurality of pin receiving apertures 92 are spaced so as to provide for selective angular adjustment of the second head 70 at angles of approximately 110°, 135°, and 160° with respect to axial centerline 12'–12". However, the angles chosen for selective adjustment are meant only as a suggestion, and is in no means limiting.

The dual-beam light assembly with adjustable posterior head 10 facilitates utilization of a single lighting device for providing ample light for at least two persons, such as where persons are walking in single file in an environment absent of light. For example, the leader of the two carries the dual-beam light assembly with adjustable posterior head 10 and selects a desired angle of the second head 70 so as to illuminate the ground in front of the follower. Being angled at a downward direction, the emitted beam is prevented from contacting the follower's eyes and causing temporary blindness.

Referring now to FIGS. 1–5, in order to prevent contact of extraneous particles with the pivot assembly 60, a protective sheath 100 is suitably adhered between the posterior end 24 of the barrel 20 and an end of the neck 72 opposite the mouth portion 76 thereof.

The protective sheath 100 is fabricated of a suitable flexible, water-repellent fabric being appropriately dyed so as to be color-coordinated with an exterior color of the dual-beam light assembly with adjustable posterior head 10.

The barrel 20, neck 32,72, and end cap 38,78 are preferably constructed of an injection molded plastic material, and are thus formed easily of recycled material. However, it is envisioned that other fabrication materials suitable for construction would include aluminum, utilizing casting, extrusion, and machining processes.

Figure 6:
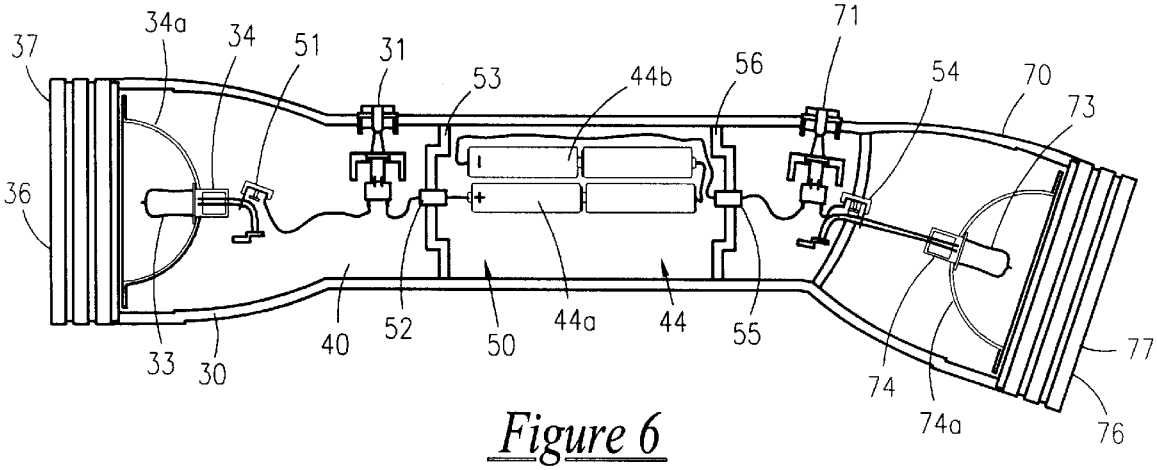
FIG. 6 is a cross-sectional view of the internal electronic components taken along lines VI—VI of FIG. 2, according to the preferred embodiment of the present invention.
Figure 7:
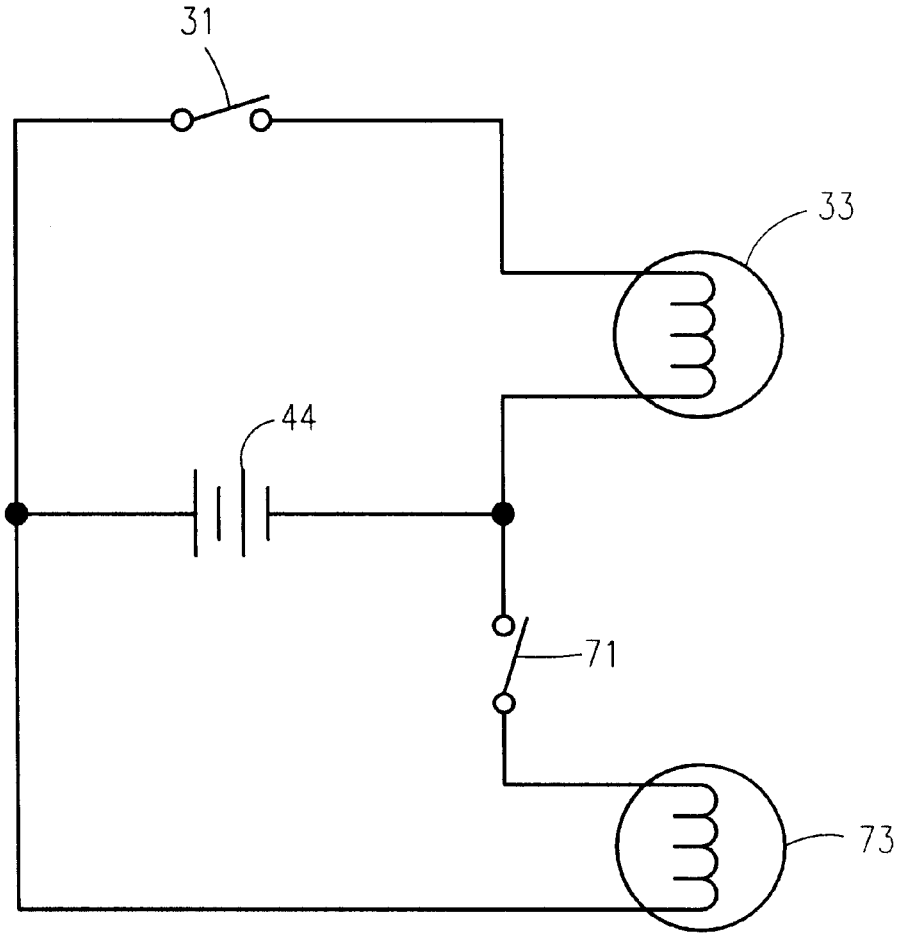
FIG. 7 is a schematic diagram of the dual-beam light assembly with adjustable posterior head according to the preferred embodiment of the present invention.

Finally, FIG. 6 illustrates internal electronic components of the dual-beam light assembly with adjustable posterior head 10, and FIG. 7 sets forth a schematic diagram thereof. The first head 30 includes a flashlight bulb 33 mounted within an electrical bulb socket 34. The first head 30 further includes a reflective conical member 34*a* closed by flashlight lens 98. The electrical bulb socket 34 is electrically connected via an electrical system comprising a power source 44, a spring clip conductor 51, a conductive spring plate 52, and a switch 31. The electrical bulb socket 34 is electrically connected to electrical terminal of switch 31. The conductive spring plate 52 is disposed within the internal cavity 40 of the barrel 20 via gasket 53 and electrically connects a positive terminal of battery 44*a* to electrical terminal of switch 31. A single depression of switch 31 actuates emission of a beam of light via the flashlight bulb 33. A subsequent depression of switch 31 serves to deactivate the emission of light from the flashlight bulb 33.

The second head 70 includes a flashlight bulb 73 mounted within an electrical bulb socket 74. The second head 70 further includes a reflective conical member 74*a* closed by flashlight lens 99. The electrical bulb socket 74 is electrically connected via the electrical system further comprising a spring clip conductor 54, a conductive spring plate 55, and a switch 71. The electrical bulb socket 74 is electrically connected to electrical terminal of switch 71. The conductive spring plate 55 is disposed within the internal cavity 40 of the barrel via gasket 56 and electrically connects a negative terminal of battery 44*b* to electrical terminal of switch 71. A single depression of switch 71 actuates emission of a beam of light via the flashlight bulb 33. A subsequent depression of switch 71 serves to deactivate the emission of light from the flashlight bulb 73. Thus, the dual-beam light assembly with adjustable posterior head 10 is designed and configured with two independent switches 31, 71 by which the first head 30 or the second head 70, or both, may emit a beam of light.

2. Operation of the Preferred Embodiment

To use the present invention, a user depresses switch 31, switch 71, or both, thereby actuating an emission of a beam of light via flashlight bulbs 33, 73. Next, the user selects a desired downward angular adjustment of the second head 70 by applying longitudinal force thereto. The pivot assembly 60 provides for selective angular adjustment of the second head 70 at angles of approximately 110°, 135°, and 160°. Once the user has selected a desired position, the second head 70 is held in position via the pivotal adjustment arm 90. Upon completing use of the present invention, the user simply depresses switches 31 and 71, thus effectively deactivating emission of light from the flashlight bulbs 33, 73.

The use of the present invention allows for the temporary lighting of two separate areas in a manner which is especially beneficial for multiple people walking in a line or down a path.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A dual-beam light assembly with adjustable posterior head comprising:

a barrel, said barrel is of an elongated, circular configuration having an anterior end opposite a posterior end, wherein said anterior end has a first head and wherein said barrel has a series of structurally integral, elongated ridge members circumferentially aligned in a spaced-apart parallel manner in order to enhance a user's grip of said barrel;

a pivot assembly, wherein said pivot assembly includes a ball joint rotatably joined to a socket member, said socket member has a T-shaped anchoring arm integrally formed at an end of said anchoring arm, and wherein said end of said anchoring arm is mounted to an internal circumferential sidewall of said barrels;

a pivotal adjustment arm;

a protective sheath; said protective sheath is fabricated of a suitable flexible, water-repellent fabric being appropriately dyed so as to be color-coordinated with an exterior color of said barrel; and a pair of independent switches.

2. The dual-beam light assembly with adjustable posterior head of claim 1, wherein said socket member includes a pair of anchoring shoulders integrally formed along opposite outer sidewalls and along a linearly elongated centerline of said socket member, said pair of anchoring shoulders are mounted to an internal circumferential sidewall of said posterior end and function to provide added structural rigidity and ensured anchoring to said socket member.

3. The dual-beam light assembly with adjustable posterior head of claim 2, wherein said ball joint includes an elongated pivoting arm with a T-shaped end mounted to an internal circumferential sidewall of said neck of said second head.

4. The dual-beam light assembly with adjustable posterior head of claim 3, wherein said pivoting arm has a spring-loaded pin located along a linearly elongated centerline of said pivoting arm for cooperating with said plurality of pin receiving apertures.

5. The dual-beam light assembly with adjustable posterior head of claim 1, wherein said first head includes a flashlight bulb mounted within an electrical bulb socket and a reflective conical member closed by a flashlight lens.

6. The dual-beam light assembly with adjustable posterior head of claim 5, wherein said electrical bulb socket is electrically connected via an electrical system.

7. The dual-beam light assembly with adjustable posterior head of claim 6, wherein said electrical system electrically connecting said electrical bulb socket includes said power source, a spring clip conductor, a conductive spring plate and one of said independent switches.

8. The dual-beam light assembly with adjustable posterior head of claim 7, wherein said electrical bulb socket is electrically connected to an electrical terminal of said independent switch, said conductive spring plate is disposed within said internal cavity of said barrel via a gasket, and said conductive spring plate electrically connects a positive terminal of a battery to an electrical terminal of one of said independent switches, whereupon a single depression of said independent switch actuates emission of a beam of light, and a subsequent depression of said independent switch deactivates emission of the beam of light.

9. The dual-beam light assembly with adjustable posterior head of claim 1, wherein:

said barrel has an internal cavity for housing a power source and internal electrical circuitry;

said anterior end has a first head with a generally conical-shaped neck, said neck has end cap receiving threads formed circumferentially around a mouth portion of said neck for allowing an end cap with complementary threads to be removably coupled to said mouth portion;

said posterior end has a second head with a generally conical-shaped neck, said neck has end cap receiving threads formed circumferentially around a mouth portion of said neck for allowing an end cap with complementary threads to be removably coupled to said mouth portion;

said second head includes a flashlight bulb mounted within an electrical bulb socket and a reflective conical member closed by a flashlight lens;

said electrical system electrically connecting said electrical bulb socket further includes a spring clip conductor, a conductive spring plate and an independent switch; and said electrical bulb socket is electrically connected to an electrical terminal of said independent switch, said conductive spring plate is disposed within said internal cavity of said barrel via a gasket, and said conductive spring plate electrically connects a negative terminal of a battery to an electrical terminal of said independent switch, whereupon a single depression of said independent switch actuates emission of a beam of light, and a subsequent depression of said independent switch deactivates emission of the beam of light.

10. The dual-beam light assembly with adjustable posterior head of claim 1, wherein said protective sheath is suitably adhered between said posterior end of said barrel and an end of said neck opposite of said mouth portion of said neck.

11. The dual-beam light assembly with adjustable posterior head of claim 1, wherein said end cap has a series of structurally integral, linearly elongated ridge members circumferentially aligned in a parallel manner around an external circumferential surface of said end cap, said ridge members function to enhance user's grip for facilitating easy removal and replacement of said end cap when battery removal and replacement is required.

12. The dual-beam light assembly with adjustable posterior head of claim 1, wherein said barrel has an internal cavity for housing a power source and internal electrical circuitry.

13. The dual-beam light assembly with adjustable posterior head of claim 12, wherein said anterior end has a first head with a generally conical-shaped neck, said neck has end cap receiving threads formed circumferentially around a mouth portion of said neck for allowing an end cap with complementary threads to be removably coupled to said mouth portion.

14. The dual-beam light assembly with adjustable posterior head of claim 13, wherein said posterior end has a second head with a generally conical-shaped neck, said neck has end cap receiving threads formed circumferentially around a mouth portion of said neck for allowing an end cap with complementary threads to be removably coupled to said mouth portion.

15. The dual-beam light assembly with adjustable posterior head of claim 14, wherein said second head includes a flashlight bulb mounted within an electrical bulb socket and a reflective conical member closed by a flashlight lens.

16. The dual-beam light assembly with adjustable posterior head of claim 15, wherein said electrical bulb socket is electrically connected via said electrical system.

17. The dual-beam light assembly with adjustable posterior head of claim 1, wherein said electrical system electrically connecting said electrical bulb socket further includes a spring clip conductor, a conductive spring plate and an independent switch.

18. A dual-beam light assembly with adjustable posterior head comprising:

a barrel, said barrel is of an elongated, circular configuration having an anterior end opposite a posterior end, and wherein said barrel has a series of structurally integral, elongated ridge members circumferentially aligned in a spaced-apart parallel manner in order to enhance a user's grip of said barrel;

a pivot assembly;

a pivotal adjustment arm, wherein said pivotal adjustment arm has an arcuate shape and includes a plurality of pin receiving apertures spaced equidistant, said pivotal adjustment arm is suitably mounted to an internal circumferential sidewall of a neck of said second head in a location being opposite of a mounting location of said pivoting arm of said ball joint, and wherein said pivotal adjustment arm functions to allow for selective pivotal adjustment of said second head to a plurality of specific angular settings;

a protective sheath; said protective sheath is fabricated of a suitable flexible, water-repellent fabric being appropriately dyed so as to be color-coordinated with an exterior color of said barrel; and a pair of independent switches.

* * * * *